US006269601B1

(12) United States Patent
Kenny et al.

(10) Patent No.: US 6,269,601 B1
(45) Date of Patent: Aug. 7, 2001

(54) GLAZING ASSEMBLY

(75) Inventors: Simon Joseph Kenny, Dublin; Daniel Patrick O'Gorman, Cork, both of (IE)

(73) Assignee: Simon Joseph Kenny, Newcastle (IE)

( * ) Notice: Subject to any disclaimer, the term of this patent is extended or adjusted under 35 U.S.C. 154(b) by 0 days.

(21) Appl. No.: 09/617,533

(22) Filed: Jul. 14, 2000

Related U.S. Application Data

(63) Continuation of application No. PCT/IE99/00002, filed on Jan. 19, 1999.

(30) Foreign Application Priority Data

Jan. 19, 1998 (IE) ..... 980035
May 12, 1998 (IE) ..... 980357

(51) Int. Cl.[7] ..... E04C 2/34

(52) U.S. Cl. ..... 52/235; 52/208; 52/786.13; 52/204.591; 52/788.1; 428/34; 428/192

(58) Field of Search ..... 52/204.593, 235, 52/786.13, 788.1, 208, 790.1, 393, 204.591, 786.1; 428/34, 81, 83, 192

(56) References Cited

U.S. PATENT DOCUMENTS 4,552,790 11/1985 Francis .
4,799,344 * 1/1989 Francis ..... 52/235
4,893,443 * 1/1990 Haber ..... 528/208
4,912,898 * 4/1990 Holmes ..... 52/235
4,961,975 10/1990 Bejnar .

FOREIGN PATENT DOCUMENTS

0130438A2 1/1985 (EP) .
0168097A1 1/1986 (EP) .
0628672A1 12/1994 (EP) .
0677623A2 10/1995 (EP) .
2167110A 5/1986 (GB) .
WO87/06644 11/1987 (WO) .
WO95/13439 5/1995 (WO) .

* cited by examiner

*Primary Examiner*—Christopher T. Kent
*Assistant Examiner*—Jennifer I. Thissell
(74) *Attorney, Agent, or Firm*—Jacobson, Price, Holman & Stern, PLLC

(57) ABSTRACT

A lazing unit (1) comprises two sheets of glass (2,3) which are separated by a spacer bar (5). An outer secondary seal (10) extends around the periphery of the glazing unit. The seal (10) has a number of peripherally spaced-apart fixing inserts (50) extending around the periphery of the glazing unit for fixing the glazing unit support (17). Each fixing insert (50) has a base wall section (51), parallel side walls (52) and end wall sections (53) which define an arcuate slot (55) closed at both ends. The configuration of the fixing inserts (50) allows simple fitting while ensuring the maximum bulk of material for structural strength. Opposed fixing inserts (50) are engaged, on assembly, by a toggle (60).

3 Claims, 4 Drawing Sheets

70
55
75
78
72
78
75

73
75
XII
55
XI
XII
XI 55
73
71

75
55
75
72
72
78
78
71

70
55
75
3
10
5
2

GLAZING ASSEMBLY

This application is a continuation of PCT/E99/00002 filed Jan. 19, 1999.

BACKGROUND OF THE INVENTION

1. Field of the Invention

The invention relates to a glazing assembly and in particular to a glazing assembly for large-scale structural applications such as curtain walling and the like.

In conventional curtain walling systems the glazing units are retained by beads of aluminium extending around the periphery thereof. While such known systems are effective the use of such aluminium beads obscures the peripheral edge of the glazing and leads to sight lines that are not aesthetically attractive. In addition, such systems are relatively expensive and difficult to install.

2. Pior Art

WO-A-95/13439 describes a glazing unit comprising glass sheets which are said to be anchored to a support by fastening elements. A protector element has a U-shaped portion that extends around the edge of the inner pane and is placed to assist in spreading a sealing compound between the panes.

EP-A-628672 describes a glazing unit in which fixing elements are embedded in a sealing material between adjacent glass plates. The fixing element has a hook-like projection which is engaged in a slot formed in the external glass sheet.

GB-A-2167110 describes a glazing unit in which a channel shaped member is engaged in the edge of double glazed sheets. A holder is used to fix the channel shaped member in place. An elastic material is provided between the head of the holder and the channel shaped members.

WO-A-87-06644 A describes a glazing unit in which a resilient member is received between glass sheets and projects beyond the plates for anchoring to a building.

There are several problems with such conventional arrangements. In particular, because of the fixing means used it is generally not possible to guarantee the integrity of the seal. In addition, these systems are generally not practical as they require modifications to the glass and/or are difficult to fit effectively. Further, the retaining force is not effectively distributed in most cases. This invention is therefore directed towards providing a glazing assembly which will overcome at least some of these problems and which may consequently be used in a wide range of applications, especially for curtain walling and the like.

SUMMARY OF THE INVENTION

According to the invention there i s provided a glazing assembly comprising a glazing unit having at least two sheets of glass, adjacent sheets being separated by a spacer means comprising an inner spacer bar and an outer seal extending around the periphery of the spacer bar and between the sheets of glass, and a fixing means for fixing the glazing unit to an adjacent support, in use, the fixing means comprising:

- a plurality of peripherally spaced-apart fixing inserts which are inserted into the outer seal leaving a depth of outer seal between the spacer bar and the inserts, each fixing insert defining a receiving slot and;
- a toggle which is movable from a locating position for the insertion of the toggle to a locking position in which the toggle is engaged in the receiving slots of laterally adjacent fixing inserts.

The invention provides a glazing assembly with a highly efficient means for sealing and fixing to a support such as a transom or mullion of a curtain walling system. Because the fixing inserts are inserted into the outer seal they are easily placed in position and yet ensure a high level of sealing and structural integrity. The outer seal is easily formed and the inserts placed at desired peripherally spaced-apart positions. The toggle which is movable from a locating to a locking position is of relatively simple construction and is easily operated. The glazing assembly is not only easy to install but also by virtue of the fixing means used the integrity of the outer seal is maintained so that the units are able to withstanding high wind loadings. In addition, because of the integrity of the seal with the fixing means used generally less seal is required and the seal sight-lines are thereby improved.

Most preferably the fixing insert is a snug fit to the faces of the adjacent sheets of glass. Because the insert is substantially flush with the inner faces of the glass sheets it is easily fitted and the integrity of sealing is ensured with maximum wind force resistance and load force transfer.

Ideally, the fixing insert is of a material to transmit a load of the glass. The fixing inserts may be of plastics or nylon material.

These features are particularly important in providing inserts of relatively cheap consistent construction which facilitate load transfer to the glass.

In a preferred arrangement the fixing insert has a base wall section, side wall and end wall sections which define the slot for receiving the toggle. Preferably, the slot is of arcuate shape.

This construction of insert is particularly advantageous as in a relatively simple moulded piece an effective fixing is provided. The configuration is particularly suitable to accommodate movement of the toggle on fixing while maintaining structural integrity.

In a preferred embodiment of invention the toggle is rotatable from the locating position to the locking position in which the toggle is engaged in the slots of adjacent inserts. This facilitates a particularly simple method of fixing.

In a preferred arrangement the toggle and a nose portion of a structural element to which it is fitted have complementary interengagable formations to lock the toggle in position relative to the structural member. This provides a more positivelocation and fixing of the toggle.

The toggle may have a hole for engagement by a fixing screw which also engages the nose of a structural element on fixing of the toggle. This is a particularly simple location and fixing system.

In one embodiment of the invention the fixing insert includes limiting means for limiting the insertion of the insert into the outer seal.

The limiting means preferably comprises a sidewardly extending flange means. The flange may be continuous or interrupted.

In one embodiment of the invention the fixing insert includes guide means for guiding the insertion of the insert into the outer seal.

The guide means may comprise side ribs extending sidewardly of the fixing insert.

The body of the insert may also be shaped, for example with inclined surfaces to facilitate ease of insertion.

The support may be a mullion or transom of a curtain walling system. The glazing assembly is particularly suited to such a system.

The invention also provides a curtain walling comprising a plurality of glazing assemblies of the invention.

BRIEF DESCRIPTION OF THE DRAWINGS

The invention will be more clearly understood from the following description thereof given by way of example only, in which:FIG.

DESCRIPTION OF THE INVENTION

Figure 1:
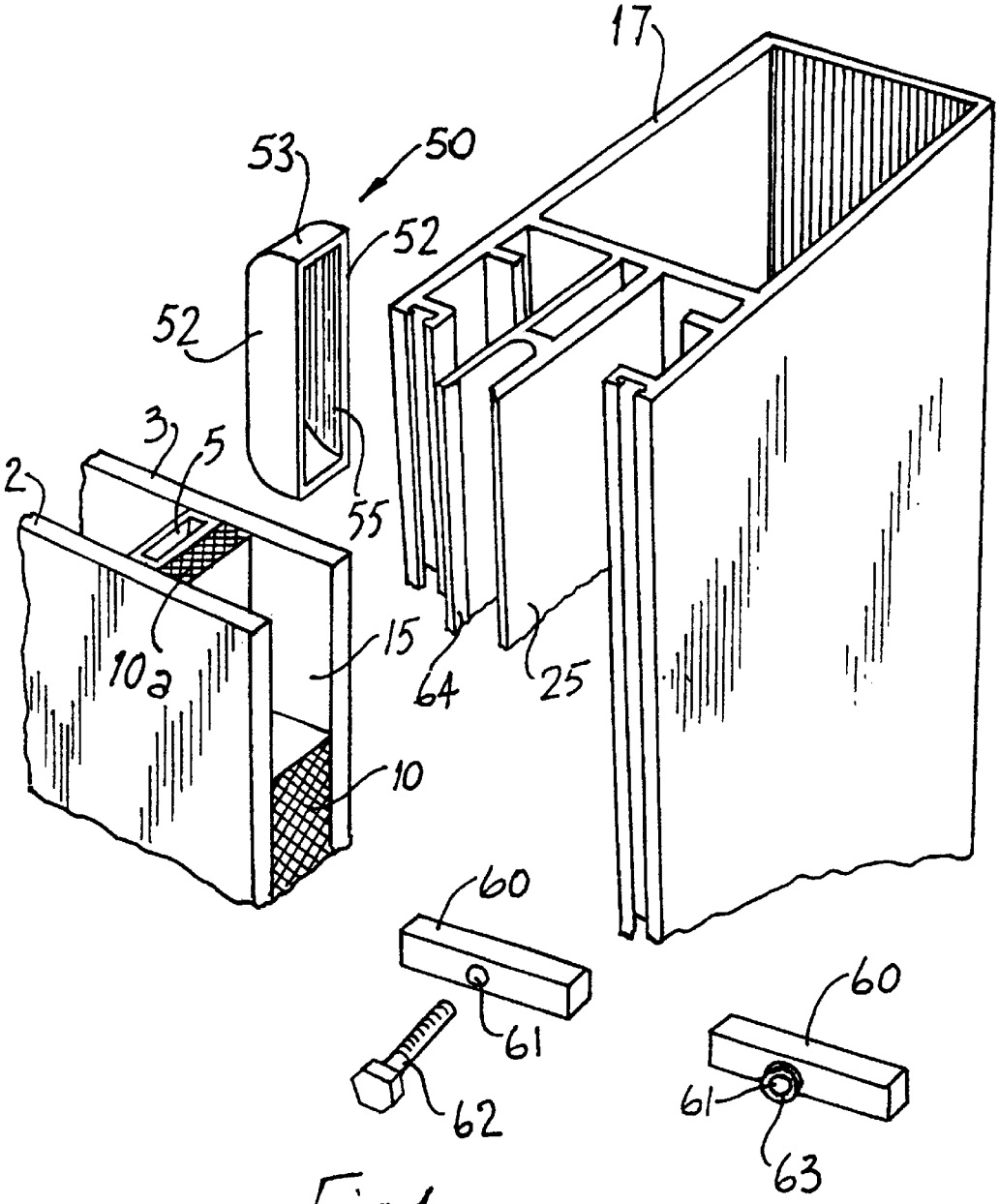
FIG. 1 is an exploded view of part of a glazing assembly according to the invention.
Figures 2, 5, 6, 7:
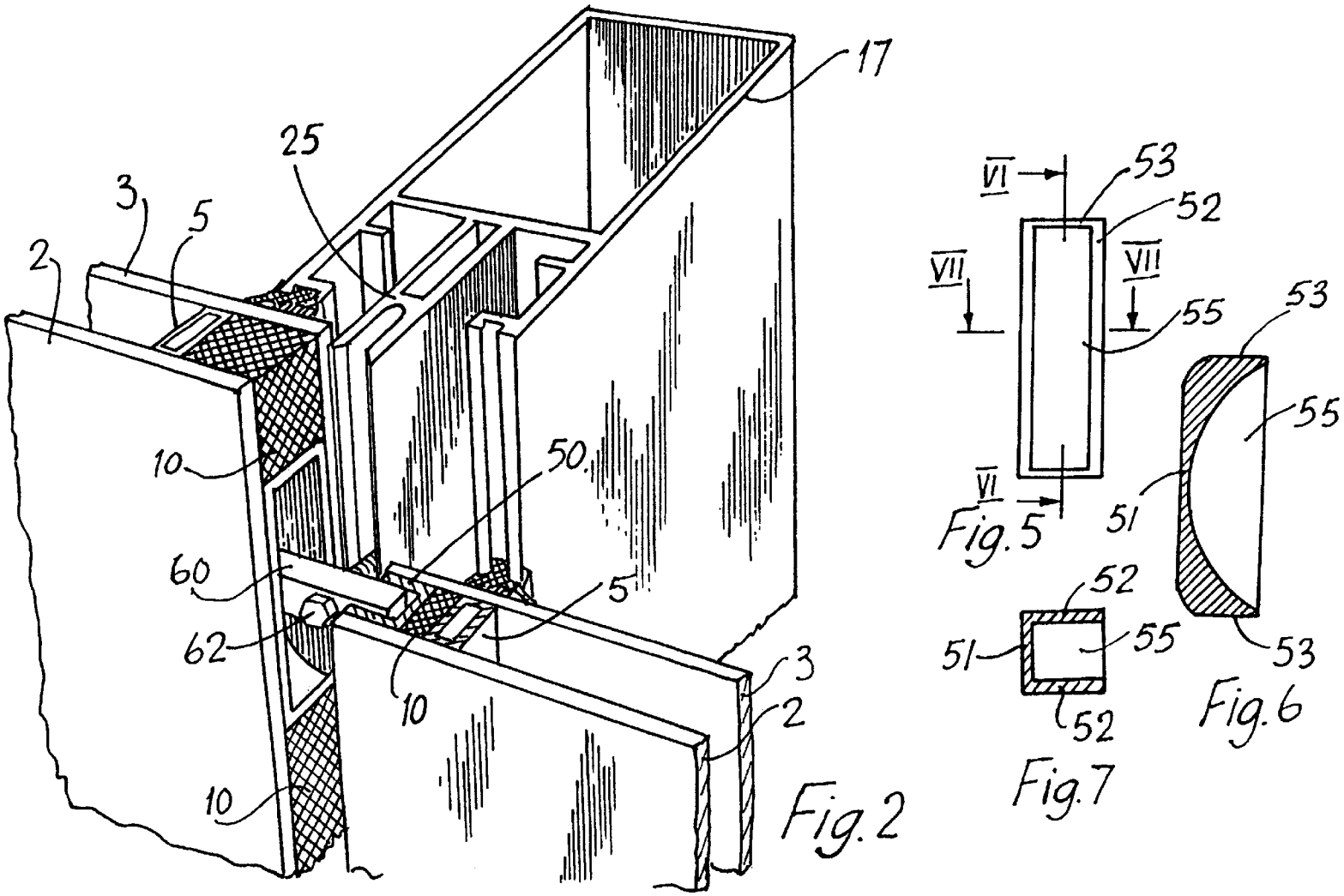
FIG. 2 is a perspective, partially cut-away view of the glazing assembly of FIG. 1.
FIG. 5 is a front view of a fixing insert of the assembly.
FIG. 6 is a cross sectional view on the line VI—VI in FIG. 5.
FIG. 7 is a cross sectional view on the line VII—VII in FIG. 5.
Figure 3:
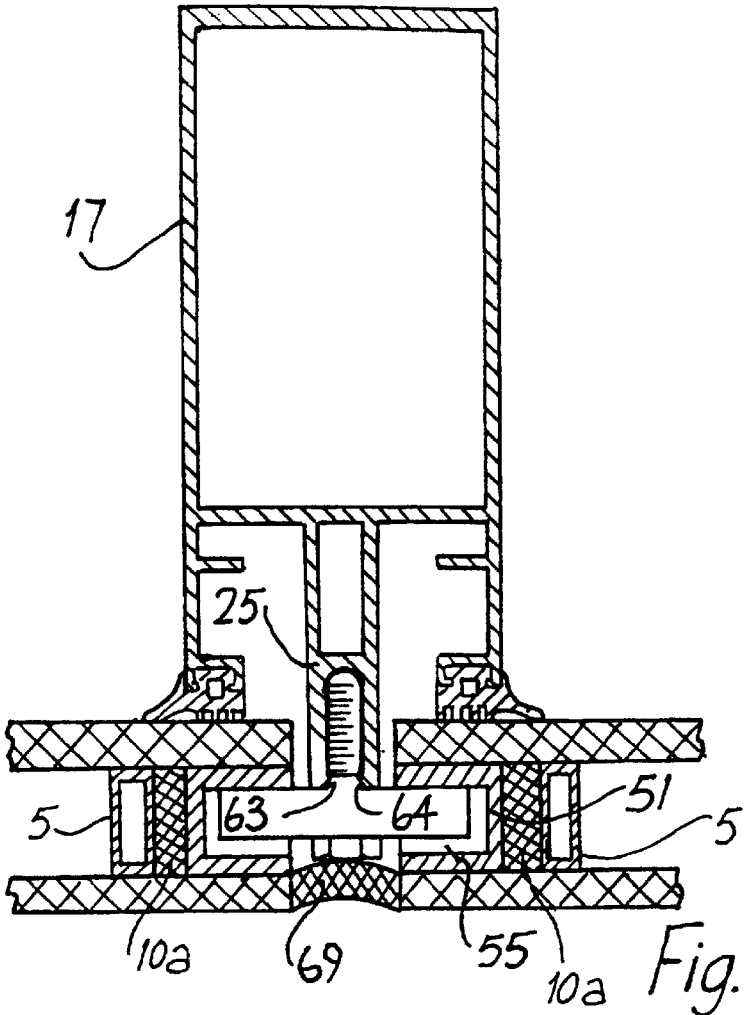
FIG. 3 is a cross sectional view of the glazing assembly of FIG. 2.

Referring to the drawings there is illustrated a glazing assembly according to the invention. A glazing unit 1 comprises two sheets of glass 2, 3 which are separated by a standard spacer bar 5 which is perforated on the inner side and contains a moisture absorbing means such as silica gel crystals. The spacer bar 5 may have primary seals (not shown) of polyisobutylene between side marginal edges and the glass sheets 2, 3.

An outer seal 10 extends around the periphery of the spacer bar 5 and between the sheets of glass 2, 3. The outer seal 10 is formed by injecting a curable silicone rubber sealant to fill the gap between the outer face of the spacer bar 5 and the outer edges of the sheets of glass 2, 3. A suitable seal is, for example, that sold under the name Elastosil 500 (Elastosil is a registered trademark of Wacher-Chemie GmbH). It is a non-sag condensation cross-linking, two-part silicone rubber with a high mechanical strength and resistance to weathering.

A plurality of peripherally spaced-apart fixing inserts 50 are inserted into the outer seal 10 leaving a depth of outer seal between the spacer bar 5 and the inserts 50. This ensures the integrity of the seal 10. The seal 10 is not removed back to the spacer bar 5 but a depth 10a of seal is retained between the spacer bar 6 and the fixing insert 50.

In this preferred case, each fixing insert 50 is typically of a plastics or nylon material having a base wall section 51, parallel side walls 52 and end wall sections 53 which define an arcuate slot 55 closed at both ends. The configuration of the fixing inserts 50 allows simple fitting while ensuring the maximum bulk of material in the insert for structural strength and fixing force transmission to the glass. It will be noted that the outer faces of the side walls 52 of the insert 50 are a snug fit i.e. substantially flush with the inner faces of the glass sheets 2, 3. This is particularly important to ensure ease of fitting, integrity of sealing and maximum wind force resistance. The fixing inserts 50 are in this case press fitted into the seal 10 before the sealant material has set.

The fixing inserts 50 are used to fix the glazing to an adjacent support 17. The support 17 is in this case a mullion bar 17 having a central projecting glazing nose 25 to receive fixing screws 62 which fix the inserts 50 and hence the glazing units into position.

Opposed fixing inserts 50 are engaged by a toggle 60 in the form of a generally rectangular piece of aluminum having a receiving hole 61 for a fixing screw 62 which screw-threadingly engages the toggle 60 and the nose 25 of the mullion bar 17. The toggle 60 has an extension 63 which projects rearwardly from the toggle to engage a correspondingly recessed portion 64 of the nose 25 of the mullion bar 17. In this way a more positive location and fixing of the toggle is achieved. It will be appreciated that the toggle projection 63 and recessed part 64 of the mullion nose 25 may be shaped to interlock only when the toggle 60 is in the locking position.

Figure 4:
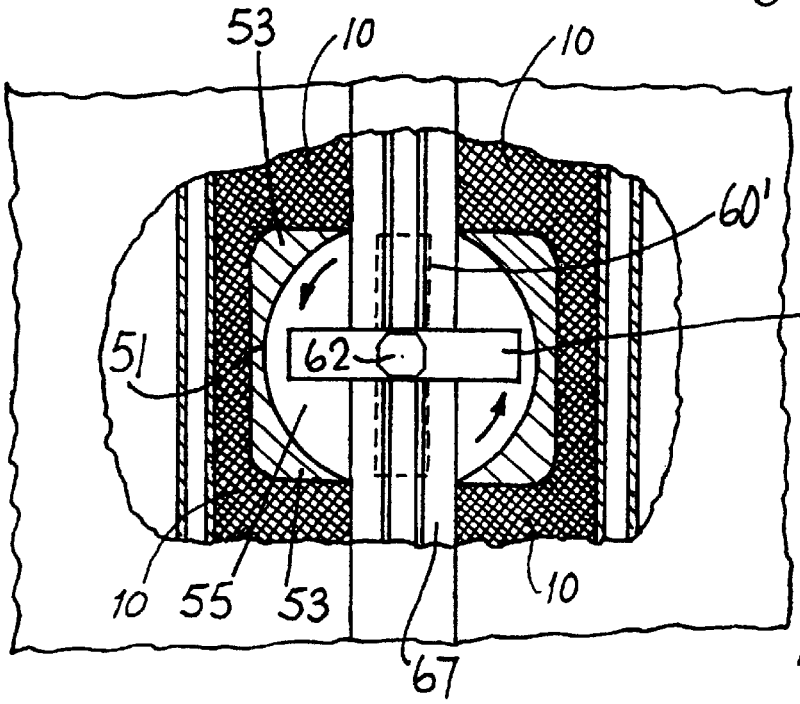
FIG. 4 is a front elevational, partially cross sectional view illustrating the operation of the glazing system.
Figures 8, 9, 10, 11, 12:
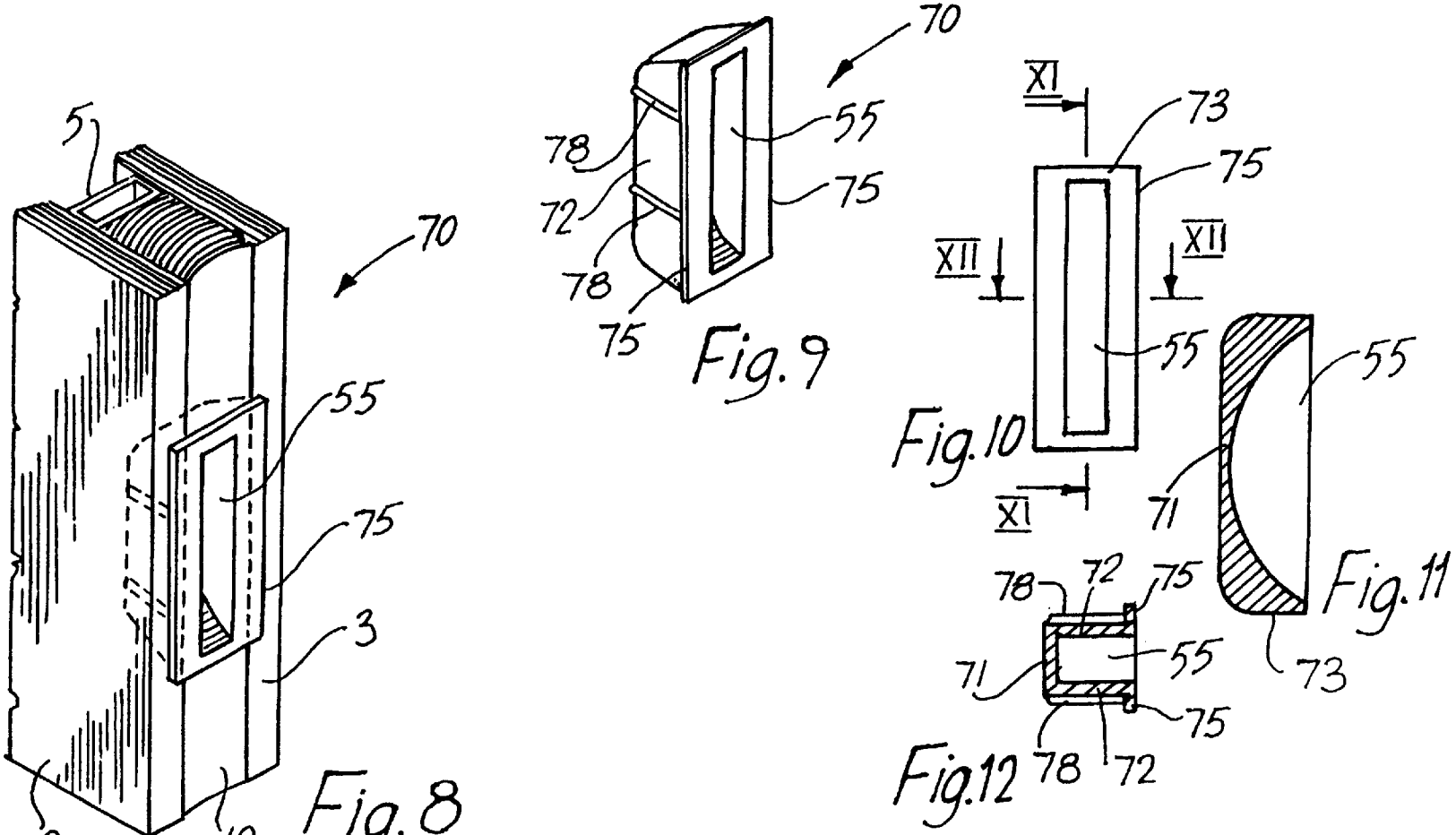
FIG. 8 is perspective view of part of another glazing system according to the invention.
FIG. 9 is a perspective view of a fixing insert used in the glazing system of FIG. 8.
FIG. 10 is a side view of the fixing insert of FIG. 9.
FIG. 11 is a cross sectional view of the line XI—XI in FIG. 10.
FIG. 12 is a cross section view on the line XII—XII in FIG. 10.

The toggle 60 is fitted in the vertical orientation illustrated by dotted lines 60 in FIG. 4 for entry through a slot 67 between adjacent glass sheets 3. The toggle 60 is then rotated to the horizontal locking position and fixed in this position by the fixing screw 62 prior to sealing with a sealing compound 69.

Referring to FIGS. 8 to 12 there is illustrated portion of another glazing system according to the invention which is similar to the glazing system described above, like parts being assigned the same reference numerals. In this case a fixing insert 70 defining the slot 55 has a base 71, a pair of side walls 72, and a pair of end walls 73. The outer faces of the end walls 73 are inclined inwardly for ease of positive engagement in the sealing material 10. Side flanges 75 extend laterally at. the outer face of the insert 70 for engagement, in use, with the edges of the sheets of glass 2, 3 to provide insert limiting means. This ensures that the retaining inserts 70 are accurately aligned, on fitting as the depth to which the inserts 70 can penetrate the seal 10 is thereby limited. In addition, the outer face of each side wall 72 includes projecting ribs 78 to more positively key the retaining insert 70 in position. The rib or ribs 78 are in this case of general semi-circular shape in transverse cross section. However, they may be of any suitable shape or indeed, keying may be provided by additional ribs and/or slots. The keying ribs 78 also provide a guide means for guiding the insertion of the insert 70 into the outer seal 10. Such a limiting and/or keying/guide means may be provided in the fixing insert of FIGS. 1 to 7.

It may be possible to form slots 15 in the outer seal 10, before it has cured, by inserting an appropriately sized forming tool into the body of the seal 10 leaving the desired fixing insert receiving slots 15 on curing of the seal.

The invention is not limited to the embodiments hereinbefore described which may be varied in construction and detail.

What is claimed is:

1. A glazing assembly comprising a glazing unit having at least two sheets of glass, adjacent sheets being separated by a spacer means comprising an inner spacer bar and an outer seal extending around the periphery of the spacer bar and between the sheets of glass, and a fixing means for fixing the glazing unit to an adjacent support, in use., the fixing means comprising:

a plurality of peripherally spaced-apart fixing inserts which are inserted into the outer seal leaving a depth of outer seal between the spacer bar and the inserts, each fixing insert defining a receiving slot;

a toggle which is movable from a locating position for insertion of the toggle to a locking position in which the toggle is engaged in the receiving slots of laterally adjacent fixing inserts; and wherein the fixing insert has a base wall section, side wall and end wall sections which define the slot for receiving the toggle.

2. The glazing assembly as claimed in claim 1 wherein the slot is of arcuate shape.

3. A glazing assembly comprising a glazing unit having at least two sheets of glass, adjacent sheets being separated by a spacer means comprising an inner spacer bar and an outer seal extending around the periphery of the spacer bar and between the sheets of glass, and a fixing means for fixing the glazing unit to an adjacent support, in use, the fixing means comprising:

a plurality of peripherally spaced-apart fixing inserts which are inserted into the outer seal leaving a depth of outer seal between the spacer bar and the inserts, each fixing insert defining a receiving slot;

a toggle which is movable from a locating position for insertion of the toggle to a locking position in which the toggle is engaged in the receiving slots of laterally adjacent fixing inserts;

wherein the fixing insert includes guide means for guiding the insertion of the insert into the outer seal; and wherein the guide means includes side ribs extending sidewardly of the fixing insert.

* * * * *